US005303527A

United States Patent [19]

Perez et al.

[11] Patent Number: 5,303,527

[45] Date of Patent: Apr. 19, 1994

[54] REMOVABLE POOL COVER SUPPORT APPARATUS

[76] Inventors: Ignacio Perez; Alain M. Perez, both of 2835 SW. 6th St., Miami, Fla. 33135

[21] Appl. No.: 62,149

[22] Filed: May 14, 1993

Related U.S. Application Data

[63] Continuation of Ser. No. 795,063, Nov. 20, 1991, abandoned.

[51] Int. Cl.[5] ..... E04C 25/08; E04H 4/00

[52] U.S. Cl. ..... 52/632; 4/494; 4/498; 249/24; 249/205

[58] Field of Search ..... 4/494–496, 4/498, 500, 501, 503, 504; 52/632; 249/13, 19, 24, 28, 29, 205

[56] References Cited

U.S. PATENT DOCUMENTS

| | | | |
|---|---|---|---|
| 1,233,743 | 7/1917 | Arndt | 52/632 |
| 1,859,055 | 5/1932 | Schlesinger | 52/632 |
| 4,078,293 | 3/1978 | Aine | 29/416 |
| 4,135,259 | 1/1979 | Scardenzan | 4/172.11 |
| 4,164,047 | 8/1979 | Barothy | 4/494 |
| 4,271,542 | 6/1981 | Wood et al. | 4/495 |
| 4,744,471 | 5/1988 | Leister | 211/7 |

FOREIGN PATENT DOCUMENTS

| | | | |
|---|---|---|---|
| 0650677 | 10/1962 | Canada | 52/632 |
| 3906275 | 4/1990 | Fed. Rep. of Germany | 4/498 |
| 1001318 | 10/1951 | France | 52/632 |
| 1284596 | 1/1962 | France | 52/632 |
| 0604012 | 4/1960 | Italy | 52/632 |
| 0140947 | 6/1953 | Sweden | 52/632 |

*Primary Examiner*—Charles E. Phillips
*Attorney, Agent, or Firm*—John R. Flanagan

[57] ABSTRACT

A removable support apparatus for supporting a swimming pool cover employs adjustable frame assemblies capable of spanning between opposite edges at opposite sides of the pool. Each frame assembly includes a pair of separate frame members placed in side-by-side relation to one another so that together they define the overall length of the frame assembly. The frame members are displacable longitudinally relative to one another to adjust the overall length of the frame assembly to match the distance between the opposite edges of the pool so that the frame assembly can fit across the pool between its opposite edges. Each frame assembly also includes an end support member attached to the outer end of each frame member and supporting the frame member from one of the opposite edges of the pool. The frame assembly further includes adjustable attaching members releasably attaching the frame members to one another in the longitudinally-displaced side-by-side relation such that the frame assembly will span between the opposite sides of the pool. The removable support apparatus also includes at least one adjustable column support member removably installed in upright standing relation on the bottom of the pool and releasably supporting a selected frame assembly, and a framework overlying and supported by the frame assemblies to span across the length and width of the swimming pool for, in turn, supporting a pool cover.

15 Claims, 3 Drawing Sheets

REMOVABLE POOL COVER SUPPORT APPARATUS

This application is a continuation of application Ser. No. 07/795,063, filed Nov. 20, 1991 now abandoned.

BACKGROUND OF THE INVENTION

1. Field of the Invention

The present invention generally relates swimming pool covers and, more particularly, is concerned with a removable support apparatus for a swimming pool cover.

2. Description of the Prior Art

Typically, in areas of limited size, below-ground swimming pools occupy a large proportion of the available space. However, occasions frequently arise, such as social events and dances when the swimming pool is not in use, where it would be desirable to be able to utilize the space over the pool. Thus, a desirable objective would be to be able to easily and quickly construct a floor or deck over the pool for use on such occasions.

Swimming pool cover support apparatuses are known in the prior patent art. Representative examples of the prior art support apparatuses are disclosed in U.S. Pat. No. 4,078,293 to Aine, U.S. Pat. No. 4,135,259 to Scardenzan, U.S. Pat. No. 4,271,542 to Wood et al, and U.S. Pat. No. 4,744,471 to Leister. However, only the support apparatus of the Scardenzan patent is designed to support a deck over the top of the swimming pool. While this prior art support apparatus may function reasonably well under the limited range of conditions for which it was designed, it appears to embody drawbacks which make it less than an optimum design to fulfill the above-mentioned desired objective.

The support apparatus of the Scardenzan patent employs a deck member composed of a lattice framework of metal tubing and a plywood panel fitted over the framework. Also, the apparatus includes a main beam structure supporting the deck member, and a bracket on a housing located to one side of the pool which pivotally mounts one end of the main beam structure. Further, a hydraulic oil pump provided in the housing is connected to a hydraulic cylinder mounted between the bracket and main beam structure. The hydraulic cylinder can be actuated to pivotally lift and lower the deck member from and onto the pool.

One drawback of the Scardenzan support apparatus is that it presents an unattractive structure at the side of the pool. Another drawback is that the apparatus occupies scarce space at the one side of the pool both when it is lifted from and lowered onto the pool. Still another drawback is that its appears to be inordinately costly. Thus, a need still exists for a pool cover support apparatus which will alleviate the above-mentioned drawbacks of the prior art apparatus and still fulfill the desired objective.

SUMMARY OF THE INVENTION

The present invention provides a removable support apparatus designed to satisfy the aforementioned needs. The removable support apparatus of the present invention does not occupy scarce space at the side of the pool either when it is installed over the pool or after it has been removed. When removed, the support apparatus can be disassembled and carried to a nearby storage location. Installation and removal of the support apparatus is extremely easy since no special training nor tools are needed. The support apparatus is designed so that the structure of the pool will not be damaged nor need to be altered. Although the removable support apparatus is designed primarily for supporting a swimming pool cover, the support apparatus can find use in other applications as well.

Accordingly, the present invention is directed to a removable support apparatus which comprises a plurality of elongated adjustable frame assemblies. The adjustable frame assemblies are capable of spanning opposite edges, for example, on opposite sides of a swimming pool. The edges can be displaced at different distances from one another in different areas of the same pool or in swimming pools of the different sizes.

Each adjustable frame assembly includes a pair of separate elongated frame members each having opposite outer and inner ends. The frame members can be placed in side-by-side relation to one another with their outer ends extending in opposite directions so that together the frame members define the overall length of the frame assembly. Also, the frame members are longitudinally displacable relative to one another to adjust the overall length of the frame assembly to match the distance between opposite sides of the swimming pool in order that the frame assembly can fit across the pool between the opposite sides thereof.

Each adjustable frame assembly also includes separate means in the form of a pair of end support members. Each end support member is attached to the outer end of one of the pair of frame members for supporting the frame member from an edge of the pool at a respective opposite side thereof. The adjustable frame assembly further includes means in the form of a plurality of adjustable attaching members for releasably securing the frame members to one another in longitudinally-displaced side-by-side relation such that the frame assembly will span the pool between its opposite sides.

Preferably, the separate frame members of each adjustable frame assembly are substantially identical to one another. Each frame member includes an upper elongated span beam having opposite outer and inner ends, a lower elongated span beam having opposite outer and inner ends and being shorter in length than the upper span member, and means in the form of a plurality of cross beams for maintaining the upper and lower span beams in a generally parallel spaced apart relation to one another. The cross beams are spaced apart along and extend in transverse relation to the upper and lower span beams. The cross beams rigidly interconnect the upper and lower span beams so as to maintain them in the generally parallel spaced apart relation to one another.

Each frame member also includes means in the form of an end brace for reinforcing the upper and lower span beams to assist in maintaining them in the generally parallel spaced apart relation to one another. The end brace extends in an inclined relation to the upper and lower span beams and is rigidly connected to their outer ends.

Each of the end support members of the adjustable frame assembly is attached to the outer end of the upper span beam of one of the frame members. The end support member includes has a generally horizontal upper portion capable of seating on a top of the edge portion of the pool at the respective opposite side thereof, and a generally vertical lower portion capable of abutting a side of the edge portion of the pool at the respective opposite side thereof.

Each adjustable attaching member of the adjustable frame assembly includes a pair of elongated telescoping elements placed between the pair of upper span beams and the pair of lower span beams of a side-by-side positioned pair of the frame members of one of the frame assemblies. The attaching member also includes a pair of upper and lower coupler elements rigidly attached to opposite outer ends of the telescoping elements and respectively receiving the pairs of adjacent upper span beams and lower span beams therethrough. An adjustment means is coupled to one of the telescoping elements and adjustable to engage the other of the telescoping elements for causing movement of the telescoping elements relative to one another in order to releasably secure the coupler elements of the attaching means to the pairs of upper and lower span beams of the pair of frame members.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
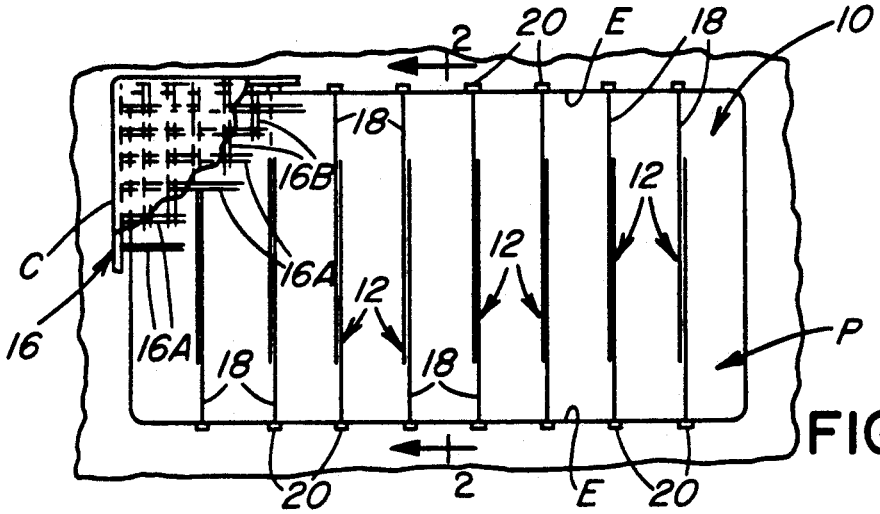
FIG. 1 is a top plan view of a removable pool cover support apparatus of the present invention installed on a below-ground swimming pool.
Figure 2:
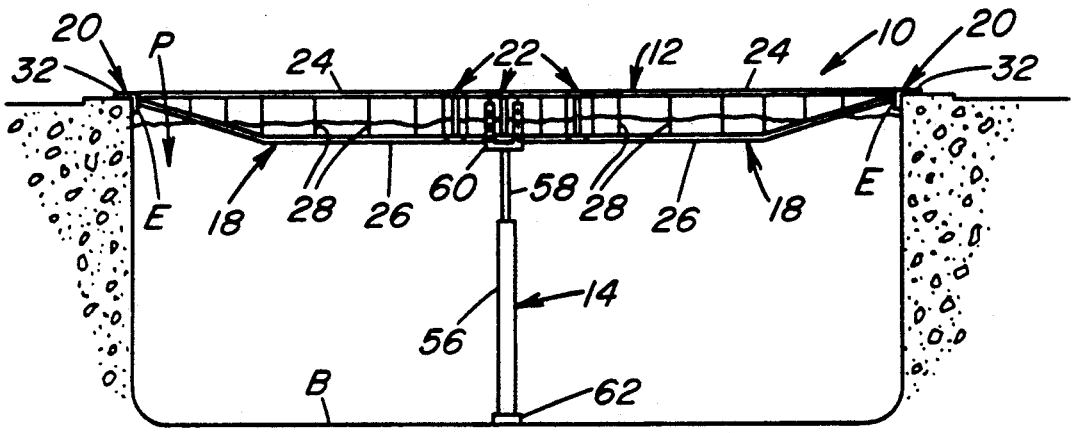
FIG. 2 is a side elevational view of one of a plurality of adjustable spanning frame assemblies of the support apparatus as seen along line 2—2 of FIG. 1.

Referring to the drawings and particularly to FIGS. 1 and 2, there is illustrated a removable pool cover support apparatus, generally designated 10, of the present invention, being mounted to a conventional below-ground swimming pool P. The removable support apparatus 10 preferably is designed for use in supporting a swimming pool cover C. However, the removable support apparatus 10 can equally find use in other applications as well.

Basically, the removable support apparatus 10 includes a plurality of elongated, separate, adjustable spanning frame assemblies 12. The adjustable frame assemblies 12 are capable of placement in spaced apart side-by-side relation to one another, spanning between a pair of opposite edges E, for example, on opposite sides of the swimming pool P. The adjustability of the frame assemblies 12 adapts the removable support apparatus 10 for use in swimming pools P of different sizes, that is, having different distances between their opposite side edges E.

Also, the removable support apparatus 10 includes one or more adjustable column members 14 and an open framework 16. Each column member 14 is adapted to stand upright on the bottom B of the pool P and support a selected one of the adjustable frame assemblies 12 at its mid-section. The open framework 16 is a large flat bed of rigidly attached, longitudinal and transverse crisscrossed members 16A, 16B adapted to overlie and rest upon the adjustable frame assemblies 12 and underlie and support the pool cover C.

Figure 3:
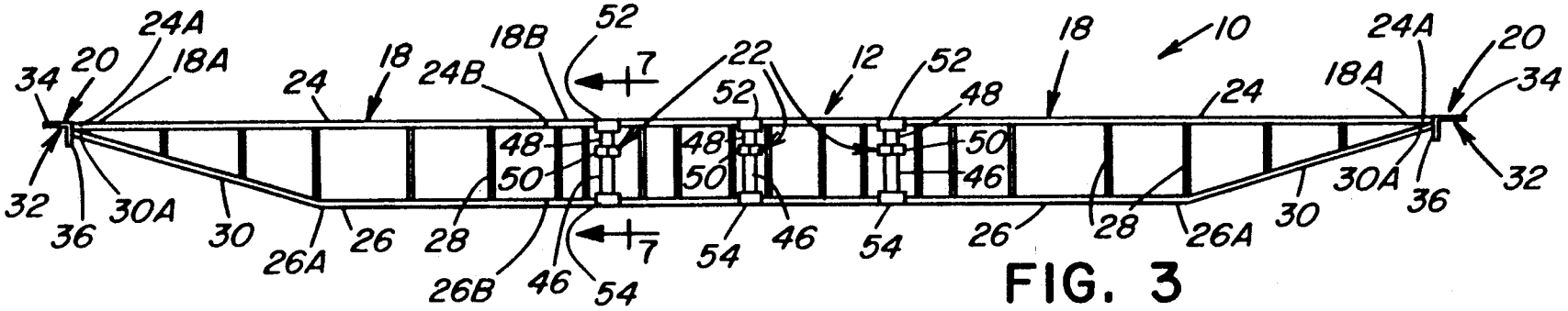
FIG. 3 is an enlarged side elevational view of the adjustable frame assemblies of FIG. 2 removed from the pool.
Figure 4:
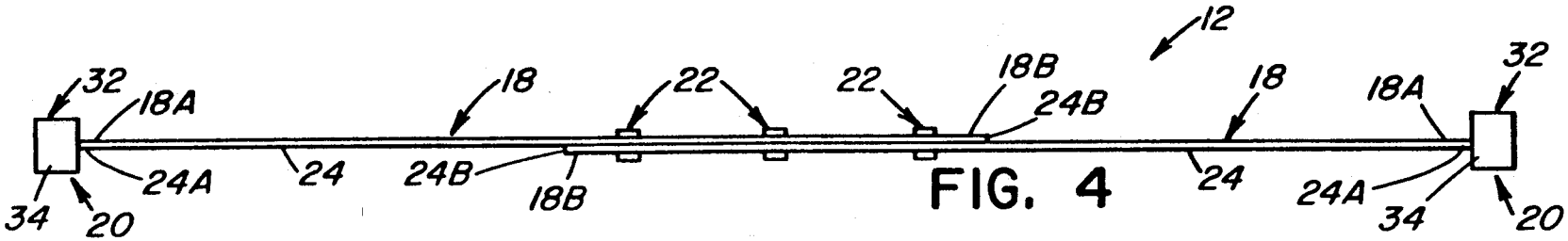
FIG. 4 is a top plan view of the adjustable frame assembly as seen along line 4—4 of FIG. 3.

Referring to FIGS. 3 and 4, each adjustable frame assembly 12 basically includes a pair of elongated frame members 18, a pair of end support members 20, and a plurality of adjustable attaching members 22. Each frame member 18 has opposite outer and inner ends 18A, 18B. Each end support member 20 is attached to the outer end 18A of one of the frame members 18 for supporting the frame member from the corresponding one side edge E of the pool P.

The frame members 18 can be placed in side-by-side relation with respect to one another with their outer ends 18A extending in opposite directions so that together the pair of frame members 18 define the overall length of the adjustable frame assembly 12. The adjustable attaching members 22 secure the frame members 18 to one another in the desired side-by-side relation.

Also, the frame members 18 are longitudinally displacable relative to one another to adjust the overall length of the frame assembly 12 to match the distance between opposite side edges E of the swimming pool P in order that the frame assembly 12 can fit across the pool P between the opposite side edges E thereof and support the framework 16, and thereby the pool cover C, across the length and width of the swimming pool P and overlying the peripheral rim of the pool. The adjustable attaching members 22 are adjustable to release the pair of frame members 18 so as to permit them to be longitudinally-displaced relative to one another to establish the desired length of the frame assembly 12 that will span the pool P between its opposite side edges E.

Figure 5:
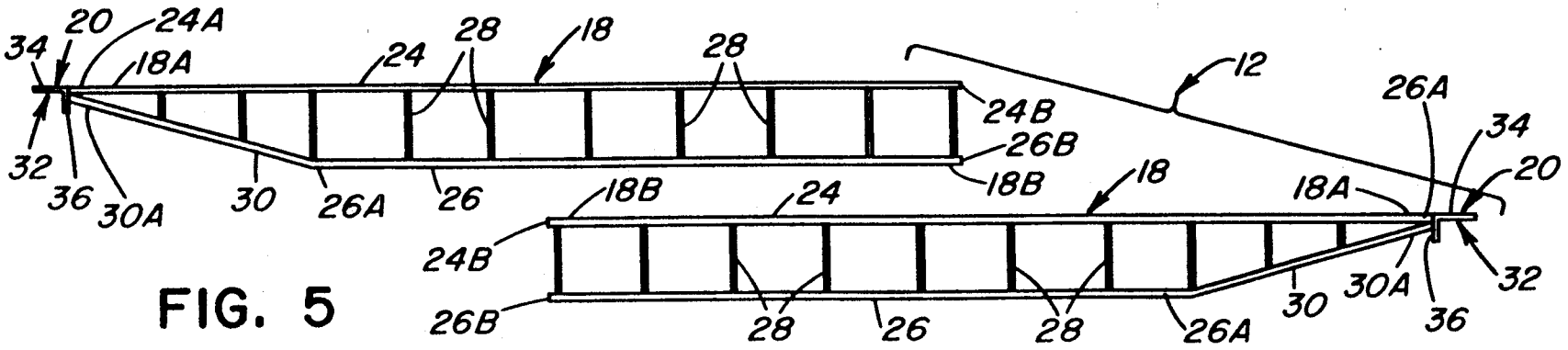
FIG. 5 is a side elevational view of a pair of frame members of the one adjustable frame assembly of FIG. 3.

Referring to FIGS. 3-5, the separate frame members 18 of each adjustable frame assembly 12 are substantially identical to one another. Each frame member 18 includes an upper elongated span beam 24 having opposite outer and inner ends 24A, 24B, and a lower elongated span beam 26 having opposite outer and inner ends 26A, 26B and being shorter in length than the upper span beam 24. Each frame member 18 also includes means in the form of a plurality of cross beams 28 rigidly connected to, and extending transversely between, the upper and lower span beams 24, 26 for maintaining the upper and lower span beams 24, 26 in a generally parallel spaced apart relation to one another.

Also, each frame member 18 includes means for reinforcing the upper and lower span beams 24, 26 to assist in maintaining them in the generally parallel spaced apart relation to one another. The reinforcing means is an end brace 30 which extends in inclined relation to the upper and lower span beams 24, 26 and is rigidly connected to their respective outer ends 24A, 26A.

Each end support member 20 of the adjustable frame assembly 12 is attached to the outer end 24A of the upper span beam 24 and the outer end 30A of the end brace member 30 of one of the frame members 18. In one construction seen in FIGS. 3-5, each end support member 20 is a right-angle bracket 32 having a generally horizontal upper portion defined by a plate 34 capable of seating on a top face of the edge E of the pool P at the respective opposite side thereof, and a generally vertical lower portion defined by another plate 36 capable of abutting a side face of the edge E of the pool P at the respective opposite side thereof. The plates 34, 36 are fixed to one another to define the right-angle configuration.

Figure 6:
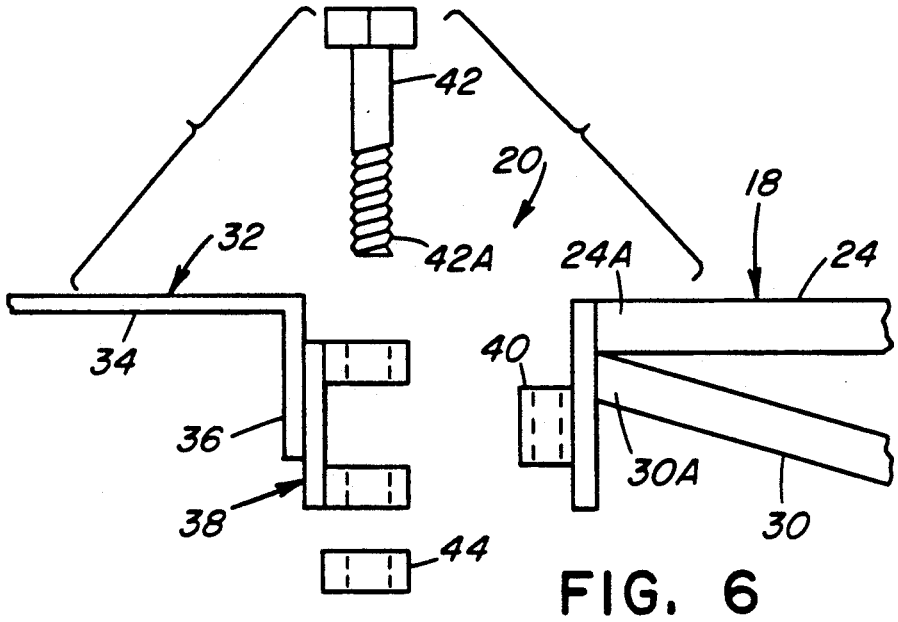
FIG. 6 is an enlarged exploded view of an end support member of the adjustable frame assembly of FIG. 3.

In another construction seen in FIG. 6, each end support member 20 employs a plurality of fastening elements to releasably attach the vertical lower plate 36 of the right-angle bracket 32 to the outer ends 24A, 30A of the respective upper span beam 24 and end brace 30. The fastening elements include a yoke 38 attached to the vertical lower plate 36 which can releasably mate with a collar 40 attached to a plate 42 affixed to the outer ends 24A, 30A of the upper span beam 24 and end brace 30. A bolt 42 is provided to fit through the aligned openings in the mated yoke 38 and collar 40 and secure them together by tightening a nut 44 on a lower threaded end portion 42A of the bolt 42.

Figure 7:
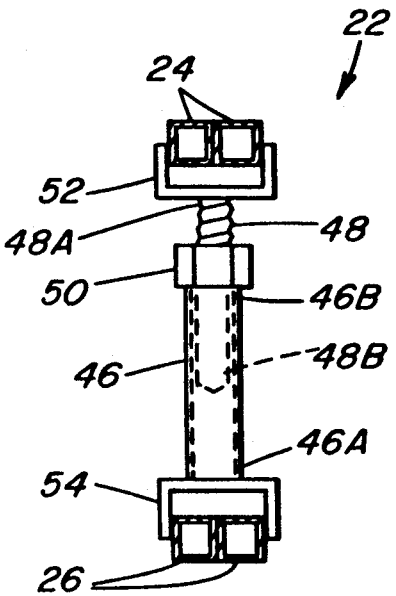
FIG. 7 is an enlarged transverse view of the adjustable frame assembly taken along line 7—7 of FIG. 3 illustrating one of a plurality of adjustable attaching members of the adjustable frame assembly.
Figure 8:
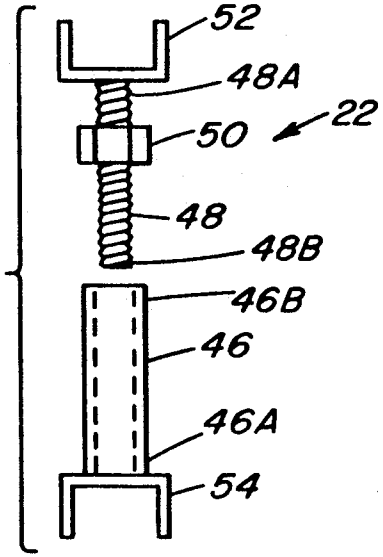
FIG. 8 is an exploded view of the adjustable attaching member of FIG. 7 by itself.

Referring to FIGS. 3, 7 and 8, the adjustable attaching members 22 of each adjustable frame assembly 12 includes a pair of elongated telescoping elements in the form of a hollow tube 46 and an externally-threaded stem 48, an adjustment element in the form of an internally-threaded nut 50 being separate from the hollow tube 46 and threaded on the stem 48, and a pair of upper and lower coupler elements in the form of respectively U-shaped and inverted U-shaped flanges 52, 54 having substantially the same configurations and being rigidly attached to opposite outer ends 46A, 48A of the tube 46 and stem 48. The inside diameter of the hollow tube 46 is of a size adapted to accommodate insertion and relative telescoping movement of the stem 48 at its inner end 48A through the inner end 46B of the tube 46.

Each attaching member 22 is installed by placing it between the adjacent upper span beams 24 and adjacent lower span beams 26 of the side-by-side positioned pair of frame members 18 comprising one frame assembly 12. As seen in FIG. 7, the upper U-shaped flange 52 of the attaching member 22 substantially underlies and receives the pair of adjacent upper span beams 24 through and the lower inverted U-shaped flange 54 of the attaching member 22 which is inverted relative to the U-shaped flange 52, substantially overlies and receives the pair of adjacent lower span beams 26 therethrough. The attaching member 22 is adjusted to the desired length by merely turning the nut 50 relative to the hollow tube 46 and stem 48 until the U-shaped flanges 52, 54 will fully seat the respective pairs of upper and lower span beams 24, 26 therein and a desired tension or load is placed on the side-by-side positioned frame members 18. By turning the nut 50 in the opposite direction the attaching members 22 can be released from the frame members 18 in order to disassemble the frame assembly 12 or to adjust the length thereof.

Figure 9:
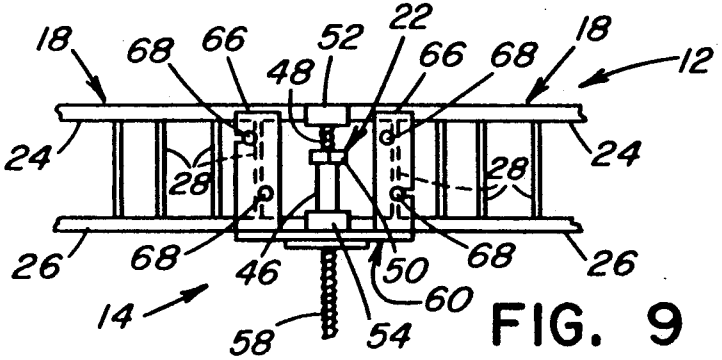
FIG. 9 is an enlarged fragmentary side elevational view of an adjustable column member of the support apparatus of FIG. 2.
Figure 10:
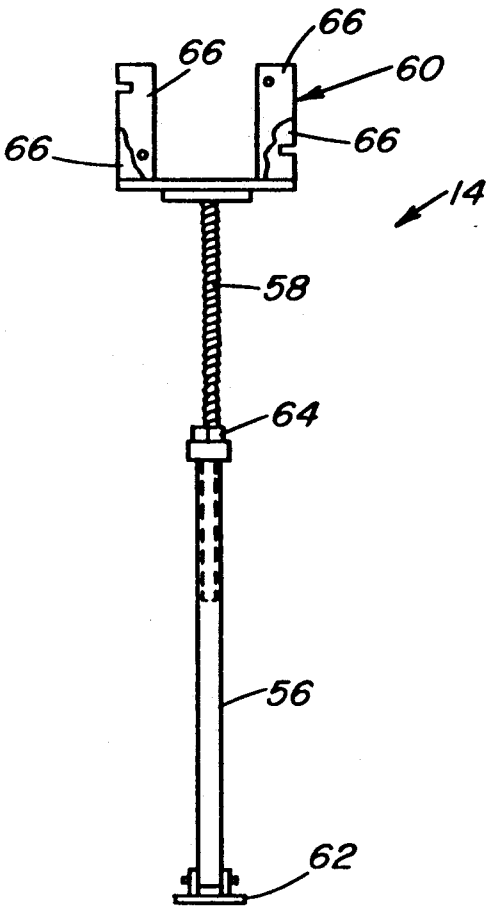
FIG. 10 is a side elevational view of the column member of FIG. 2 by itself.

Referring to FIGS. 1, 9 and 10, each adjustable column member 14 of the removable support apparatus 10 includes an elongated hollow tubular post 56, an elongated externally-threaded rod 58, a bifurcated support bracket 60, a pivotal base pad 62, and an adjustment element in the form of an internally-threaded nut 64 threaded on the rod 58. The support bracket 60 is rigidly attached on the upper end of the rod 58. The inside diameter of the hollow post 56 is of a size adapted to accommodate insertion and telescoping movement of the rod 58 relative to the post 56.

The column member 14 is installed by placing its pivotal base pad 62 upon the bottom B of the pool P so as to underlie a selected one of the frame assemblies 12 to be supported. Portions of the frame members 18 adjacent opposite sides of one of the attaching members 22 are received between pairs of upright spaced plates 66 of the support bracket 60 such that a pair of the cross beams 28 of the adjacent frame members 18 extend vertically through the space between vertically and horizontally spaced bolts 68 mounted to and extending between the plates 66. The column member 14 is adjusted to the desired height by merely turning the nut 64 relative to the threaded rod 58 until the column member 14 is slightly loaded by the frame assembly 12. By turning the nut 64 in the opposite direction the column member 14 can be released from the frame assembly 12 in order to disassemble the frame assembly 12 or to remove the column member 14.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An adjustable frame assembly of a support apparatus for use in spanning a pair of opposite edges at opposite sides of a swimming pool, comprising:

(a) a pair of separate elongated spanning frame members each having opposite outer and inner ends, said frame members being placed in side-by-side relation to one another with said outer ends extending in opposite directions so that said frame members together define the overall length of said frame assembly, said frame members being longitudinally displacable relative to one another to adjust the overall length of said frame assembly to match the distance between opposite sides of a swimming pool in order that said frame assembly can fit across the pool between the opposite sides thereof, each of said separate frame members including an upper elongated span beam having opposite outer and inner ends and a lower elongated span beam having opposite outer and inner ends;

(b) a pair of end support members each attached to said outer end of one of said frame members for supporting said frame member from an edge of the pool at a respective opposite side thereof; and (c) a plurality of adjustable attaching members for releasably securing said frame members to one another in said longitudinally-displaced side-by-side relation such that said frame assembly will span the pool between the opposite sides thereof, each of said adjustable attaching members including (i) a pair of elongated telescoping elements placed between said pair of upper span beams and said pair of lower span beams of a side-by-side positioned pair of said frame members of said frame assembly, said telescoping elements being an externally-threaded stem and a hollow tube adapted to accommodate insertion and relative telescoping movement of an inner end portion of said stem within an inner end portion of said hollow tube, (ii) a pair of upper and lower coupler elements having substantially the same configurations and being rigidly attached to opposite outer end portions of said threaded stem and hollow tube, said upper coupler element being a U-shaped flange adapted to substantially underlie and releasably receive said pair of adjacent upper span beams therethrough and said lower coupler element being an inverted U-shaped flange adapted to substantially overlie and releasably receive said pair of adjacent lower span beams therethrough, and (iii) an internally-threaded adjustment nut separate from said hollow tube and threadably coupled over said stem and being threadably adjustable along said stem to engage said inner end portion of said hollow tube for causing movement of said threaded stem and hollow tube relative to one another in order to releasably secure said coupler elements of said attaching means to said pairs of upper and lower span beams of said pair of frame members.

2. The frame assembly of claim 1 wherein said separate frame members are substantially identical to one another.

3. The frame assembly of claim 1 wherein each of said separate frame members also includes means interconnecting said upper and lower span beams for maintaining said upper and lower span beams in a generally parallel spaced apart relation to one another.

4. The frame assembly of claim 3 wherein each of said end support members is attached to said outer end of said upper span beam of one of said frame members.

5. The frame assembly of claim 4 wherein said end support member includes a bracket having a generally horizontal upper portion capable of seating on a top face of the edge of the pool at the respective opposite side thereof and a generally vertical lower portion capable of abutting a side face of the edge of the pool at the respective opposite side thereof.

6. The frame assembly of claim 5 wherein said end support member also includes a plurality of fastening elements respectively attached to said vertical lower portion of said bracket and said outer end of said upper span beam of said frame member, said fastening elements being releasably matable together for releasably securing said bracket to said respective frame member.

7. The frame assembly of claim 6 wherein said end support ;member is attached to said outer end of said upper span beam and an outer end of said end brace of said frame member.

8. The frame assembly of claim 3 wherein:

said lower elongated span beam of each said frame member has a shorter length than said upper span beam thereof; and said frame assembly further includes a reinforcing end brace extending in inclined relation to said upper and lower span beams of each said frame member and rigidly connected to outer ends of said upper and lower span beams to assist in maintaining said upper and lower span beams at said generally parallel spaced apart relation to one another.

9. The frame assembly of claim 3 wherein said maintaining means includes a plurality of cross beams spaced apart along and extending in transverse relation to said upper and lower span beams of said frame member and rigidly interconnecting said upper and lower span beams so as to maintain them in the generally parallel spaced apart relation to one another.

10. A removable pool cover support apparatus for a swimming pool, comprising:

(a) a plurality of elongated frame assemblies being removably installable in generally parallel spaced apart relation to one another across a swimming pool with opposite ends of said frame assemblies removably supported from a pair of opposite side edges of the pool; and (b) at least one adjustable column member being removably installable in a generally upright standing relation on the bottom of the pool for releasably supporting one of said frame assemblies between said opposite ends thereof;

(c) each of said frame assemblies including a pair of separate elongate spanning frame members each having opposite outer and inner ends, said frame members being placed in side-by-side relation to one another with said outer ends extending in opposite directions so that said frame members together define the overall length of said frame assembly, said frame members being longitudinally displacable relative to one another to adjust the overall length of said frame assembly to match the distance between opposite sides of a swimming pool in order that said frame assembly can fit across the pool between the opposite sides thereof, each of said separate frame members including an upper elongated span beam having opposite outer and inner ends and a lower elongated span beam having opposite outer and inner ends;

(d) each of said frame assemblies also including a plurality of adjustable attaching members for releasably securing said frame members to one another in said longitudinally-displaced side-by-side relation such that said frame assembly will span the pool between the opposite sides thereof, each of said adjustable attaching members including (i) a pair of elongated telescoping elements placed between said pair of upper span beams and said pair of lower span beams of a side-by-side positioned pair of said frame members of one of said frame assemblies, said telescoping elements being an externally-threaded stem and a hollow tube adapted to accommodate insertion and relative telescoping movement of said inner end portion of said stem within said inner end portion of said hollow tube, (ii) a pair of upper and lower coupler elements having substantially the same configurations and being rigidly attached to opposite outer end portions of said threaded stem and hollow tube, said upper coupler element being a U-shaped flange adapted to substantially underlie and releasably receive said pair of adjacent upper span beams therethrough and said lower coupler element being an inverted U-shaped flange adapted to substantially overlie and releasably receive said pair of adjacent lower span beams therethrough, and (iii) an internally-threaded adjustment nut separate from said hollow tube and threadably coupled over said stem and being threadably adjustable along said stem to engage said inner end portion of said hollow tube for causing movement of said threaded stem and hollow tube relative to one another in order to releasably secure said coupler elements of said attaching means to said pairs of upper and lower span beams of said pair of frame members.

11. The support apparatus of claim 10 wherein each of said frame assemblies also includes a pair of end support members each attached to said outer end of one of said frame members for supporting said frame member from an edge of the pool at a respective opposite side thereof.

12. The support apparatus of claim 10 wherein each frame member also includes:

a plurality of cross beams being spaced apart along and extending in transverse relation to said upper and lower span beams and rigidly interconnecting said upper and lower span beams so as to maintain them in spaced apart parallel relationship to one another with said inner ends of said upper and lower span beams in alignment with one another and with said outer end of said lower span beam being offset from said outer end of said upper span beam; and an end brace extending in inclined relation to said upper and lower span beams and rigidly connected to said offset outer ends of said upper and lower span beams to assist in maintaining said upper and lower span beams at said generally parallel spaced apart relation to one another.

13. A removable pool cover support apparatus for a swimming pool, comprising:

(a) a plurality of elongated longitudinally-adjustable frame assemblies being removably installable in generally parallel spaced apart relation to one another across a swimming pool with opposite ends of said frame assemblies removably supported from a pair of opposite side edges of the pool; and (b) a framework overlying and supported by said frame assemblies so as to span across the length and width of the swimming pool and, in turn, support a pool cover thereon;

(c) each of said frame assemblies including a pair of separate elongated spanning frame members each having opposite outer and inner ends, said frame members being placed in side-by-side relation to one another with said outer ends extending in opposite directions so that said frame members together define the overall length of said frame assembly, said frame members being longitudinally displacable relative to one another to adjust the overall length of said frame assembly to match the distance between opposite sides of a swimming pool in order that said frame assembly can fit across the pool between the opposite sides thereof, each of said separate frame members including an upper elongated span beam having opposite outer and inner ends and a lower elongated span beam having opposite outer and inner ends;

(d) each of said frame assemblies also including a plurality of adjustable attaching members for releasably securing said frame members to one another in said longitudinally-displaced side-by-side relation such that said frame assembly will span the pool between the opposite sides thereof, each of said adjustable attaching members including (i) a pair of elongated telescoping elements placed between said pair of upper span beams and said pair of lower span beams of a side-by-side positioned pair of said frame members of one of said frame assemblies, said telescoping elements being an externally-threaded stem and a hollow tube adapted to accommodate insertion and relative telescoping movement of an inner end portion of said stem within an inner end portion of said hollow tube, (ii) a pair of upper and lower coupler elements having substantially the same configurations and being rigidly attached to opposite outer end portions of said threaded stem and hollow tube, said upper coupler element being a U-shaped flange adapted to substantially underlie and releasably receive said pair of adjacent upper span beams therethrough and said lower coupler element being an inverted U-shaped flange adapted to substantially overlie and releasably receive said pair of adjacent lower span beams therethrough, and (iii) an internally-threaded adjustment nut separate from said hollow tube and threadably coupled over said stem and being threadably adjustable along aid stem to engage said inner end portion of said hollow tube for causing movement of said threaded stem and hollow tube relative to one another in order to releasably secure said coupler elements of said attaching means to said pairs of upper and lower span beams of said pair of frame members.

14. The support apparatus of claim 13 wherein each of said frame assemblies also includes a pair of end support members each attached to said outer end of one of said frame members for supporting said frame member from an edge of the pool at a respective opposite side thereof.

15. An adjustable frame assembly of a support apparatus for use in spanning a pair of spaced locations, comprising:

(a) a pair of separate elongated spanning frame members placed in side-by-side relation such that said frame members together define the overall length of said frame assembly, said frame members being longitudinally displacable relative to one another to adjust the overall length of said frame assembly to match the distance between a pair of spaced locations in order that said frame assembly can fit across the space between the pair of locations, each of said separate frame members including upper and lower elongated span beams; and (b) a plurality of adjustable attaching members for releasably securing said frame members to one another in said longitudinally-spaced side-by-side relation, each of said adjustable attaching members including (i) a pair of elongated telescoping elements placed between said pair of upper span beams and said pair of lower span beams of a side-by-side positioned pair of said frame members, said telescoping elements being an externally-threaded stem and a hollow tube adapted to accommodate insertion and relative telescoping movement of an inner end portion of said stem within an inner end portion of said hollow tube, (ii) a pair of upper and lower coupler elements having substantially the same configurations and being rigidly attached to opposite outer ends of said threaded stem and hollow tube, said upper coupler element being a U-shaped flange adapted to substantially underlie and releasably receive said pair of adjacent upper span beams therethrough and said lower coupler element being an inverted U-shaped flange adapted to substantially overlie and releasably receive said pair of adjacent lower span beams therethrough, and (iii) an internally-threaded adjustment nut being separate from said hollow tube and threadably coupled over said stem and being threadably adjustable along said stem to engage said inner end portion of said hollow tube for causing movement of said threaded stem and hollow tube relative to one another in order to releasably secure said coupler elements of said attaching means to said pairs of upper and lower span beams of said pair of frame members.

* * * * *